US008490234B2

(12) United States Patent
Rowell et al.

(10) Patent No.: US 8,490,234 B2
(45) Date of Patent: Jul. 23, 2013

(54) TRAVEL EASY ADJUSTABLE DECK

(76) Inventors: Joseph P. Rowell, Van Alstyne, TX (US); Kristina A. Rowell, Van Alstyne, TX (US)

( * ) Notice: Subject to any disclaimer, the term of this patent is extended or adjusted under 35 U.S.C. 154(b) by 0 days.

(21) Appl. No.: 13/200,205

(22) Filed: Sep. 21, 2011

(65) Prior Publication Data

US 2012/0096655 A1 Apr. 26, 2012

Related U.S. Application Data

(60) Provisional application No. 61/455,570, filed on Oct. 22, 2010.

(51) Int. Cl.
*E04B 5/02* (2006.01)

(52) U.S. Cl.
USPC ..... 14/2.4; 52/126.6; 52/263

(58) Field of Classification Search
USPC ..... 52/126.6, 126.7, 263; 14/2.4, 73
See application file for complete search history.

(56) References Cited

U.S. PATENT DOCUMENTS

| | | | | | |
|---|---|---|---|---|---|
| 3,067,843 | A | * | 12/1962 | Rushtoh et al. | 52/126.6 |
| 3,318,057 | A | * | 5/1967 | Norsworthy | 52/126.6 |
| 3,808,757 | A | | 5/1974 | Greenwood | |
| 3,811,237 | A | * | 5/1974 | Bettinger | 52/126.6 |
| 3,924,370 | A | | 12/1975 | Cauceglia et al. | |
| 4,277,923 | A | | 7/1981 | Rebentisch et al. | |
| 4,347,638 | A | | 9/1982 | Weaver | |
| 4,447,998 | A | * | 5/1984 | Griffin | 52/126.6 |
| 4,598,510 | A | | 7/1986 | Wagner, III | |
| 4,685,258 | A | * | 8/1987 | Av-Zuk | 52/126.6 |
| 4,747,243 | A | | 5/1988 | Anstead | |
| 4,759,162 | A | | 7/1988 | Wyse | |
| 4,835,924 | A | * | 6/1989 | Blacklin et al. | 52/263 |
| 5,193,878 | A | | 3/1993 | Weaver | |
| 5,417,468 | A | | 5/1995 | Baumgartner | |
| 6,363,685 | B1 | * | 4/2002 | Kugler | 52/745.05 |
| 6,442,906 | B1 | * | 9/2002 | Hwang | 52/126.6 |
| 6,736,446 | B1 | | 5/2004 | Johnson | |
| 7,353,639 | B2 | | 4/2008 | Carson | |
| 7,698,860 | B2 | * | 4/2010 | Hockemeyer et al. | 52/263 |
| 7,918,059 | B2 | * | 4/2011 | Repasky | 52/263 |
| 8,011,148 | B2 | * | 9/2011 | Bertke et al. | 52/263 |
| 2005/0076590 | A1 | * | 4/2005 | Wang et al. | 52/263 |

* cited by examiner

*Primary Examiner* — Gary Hartmann
(74) *Attorney, Agent, or Firm* — Charlotte W. Catlett

(57) ABSTRACT

The present invention is a modular deck system with height adjustable leg assemblies. The deck modules each have a top panel, a support frame, and a leg receptacle. The leg assemblies include a base foot, an adjustment bolt and a leg bracket with four legs extending perpendicularly from a bracket plate. A height adjustment bolt is fixed to the base of the leg assembly and extends perpendicularly from the base through an aperture in the bracket plate. The deck modules are placed adjacent to each other, side-by-side and end-to-end in the desired layout, then secured with the leg assemblies. Leveling of the deck modules is achieved through rotation of the adjustment bolts.

7 Claims, 10 Drawing Sheets

TRAVEL EASY ADJUSTABLE DECK

BACKGROUND OF THE INVENTION

This invention relates to portable deck systems. More particularly, the present invention is a lightweight, portable, modular deck system assembled without tools, and adjustable to create a level support surface of indefinite size and configuration.

Prior art portable decks, commonly used with recreational vehicles or trailers, are limited in use. For example, in U.S. Pat. No. 3,808,757 to Greenwood, 1974, entitled "Dismanteable Porch Installation," an elevated porch with guardrails and stair access is shown. Additional examples of porches and decks including stair access and limited portablility include U.S. Pat. No. 7,353,639 to Carson, entitled "Recreational Vehicle Portable Deck"; U.S. Pat. No. 6,737,446 to Johnson, entitled, "Portable Camper Deck with a Collapsible Frame for Storage"; U.S. Pat. No. 5,417,468 to Baumgartner, entitled, "Recreational Vehicle Foldable Deck"; U.S. Pat. No. 5,193,878 to Weaver, entitled, "Foldable Vehicle Platform"; U.S. Pat. No. 4,759,162 to Wyse, entitled "Modular Platform Assembly"; U.S. Pat. No. 4,747,243 to Anstead, entitled, "Collapsible Porch"; U.S. Pat. No. 4,598,510 to Wagner III, entitled, "Modular and Expandable Platform System"; U.S. Pat. No. 4,347,638 to Weaver, entitled, "Rectractable Porch and Stair Apparatus for Trailers"; U.S. Pat. No. 4,277,923 to Rebentisch, entitled, "Support Pedestal Assembly for a Raised Floor System"; and U.S. Pat. No. 3,924,370 to Cauceglia, entitled, "Raised Floor with Clamped Panel Support."

These disclosures, as well as other non-permanent deck and raised floor systems, do not satisfactorily meet the needs of consumers with temporary outdoor deck needs such as campers and vacationers with recreational vehicles and trailers. A majority of these aforementioned decks are not lightweight enough for a single individual to carry. In addition, most are not transportable in a vehicle where limited storage space and added towing weight must be considered. Some of these previous designs have not accounted for variations in terrain, do not facilitate use in multiple locations, and are limited to a specific size and configuration.

The principal objective of the present invention is to provide a deck system which is sturdy, light-weight, small enough to be transportable, large enough to be practically functional, easily assembled and disassembled, high enough to rise above rain levels, low enough to not require stairs or a ramp system for use, and flexible enough to adjust to fluctuations in topography while providing a sturdy, even and level walking surface.

BRIEF SUMMARY OF INVENTION

The invention is a solution where a flat, constant walking surface is desired without restrictions of permanency. This invention permits both flexibility in location and expansion of overall deck size, while also allowing for variance in height. It is light-weight and compact enough to be portable, easily stored and packed for travel.

The deck system includes a plurality of deck modules and leg assemblies. The deck modules each have a top panel, a support frame, and a leg receptacle, whereas the leg assemblies include a base foot, an adjustment bolt and a leg bracket with four legs extending perpendicularly from the bracket plate. The deck modules are placed adjacent to each other side-by-side and end-to-end in the desired layout, then secured together with the leg assemblies.

In the preferred embodiment, the support frame is rectangular and includes a leg receptacle in each of the four corners, adjacent to the bottom of the frame. The leg assembly includes four legs uniformly spaced around the edge of the bracket plate in each corner. The threaded adjustment bolt is fixed to the base of the leg assembly and extends perpendicularly from the base through a central aperture in the bracket plate. In this configuration, the leveling of the deck modules is achieved through rotation of each bolt for the vertical height adjustment of each leg bracket over the base-foot of each leg assembly.

In one embodiment, the leg assembly height is adjusted before insertion of each leg into a receptacle; in another embodiment, the height of the leg bracket on the assembly is adjusted after the modules are connected by use of a tool to turn the bolt.

In the instant invention, the leg assemblies are sturdy, repositionable connections between multiple decking sections. The ability to change the height of the leg bracket on the leg assembly provides a range of adjustment that overcomes common outdoor terrain found in areas of natural erosion often encountered in campgrounds, backyards or garden settings. This range of adjustment provides an escape from runoff and promotes an easier, even walking surface over topographic dips, cracks, rocks, and mounds. In addition, the leg brackets of the leg assemblies may be rotated under the modules so the unengaged legs do not protrude beyond the outer edge of the assembled modular deck system.

The modular deck system is robust, heat resistant, and maintenance free. The open mesh design of the deck panel reduces the amount of mud, dust, grass, and other debris carried inside the living space as well as providing quick and easy visibility of any objects underneath the deck.

Ease of deck expansion in the present invention is limited only by the area in which the modular deck system is placed. The desired deck layout can be easily and quickly accomplished without the required use of special tools or excessive strength. The multiple placement options of deck sections allows for the final walkway or deck design to be created according to personal preference, event, or venue needs.

One advantage of the instant invention is that due to the overall stackability and portability of the decking unit itself, only minimal space for storage in travel vehicles is required. In addition, overall weight considerations can be easily customized according to the individual travelers' needs or preferences.

Another advantage of the instant invention is the low ground clearance of the deck module. Use of the modular deck system also improves accessibility to elevated places by users of wheel-chairs, walkers, or other ambulatory aids. Mobility into previously inaccessible areas can now be achieved without the need of permanent ramps or stairs.

BRIEF DESCRIPTION OF DRAWINGS

The invention will be better understood and its numerous objects and advantages will become more apparent to those skilled in the art by reference to the following drawings, in conjunction with the accompanying specification, in which.

DETAILED DESCRIPTION OF INVENTION

Figure 1:
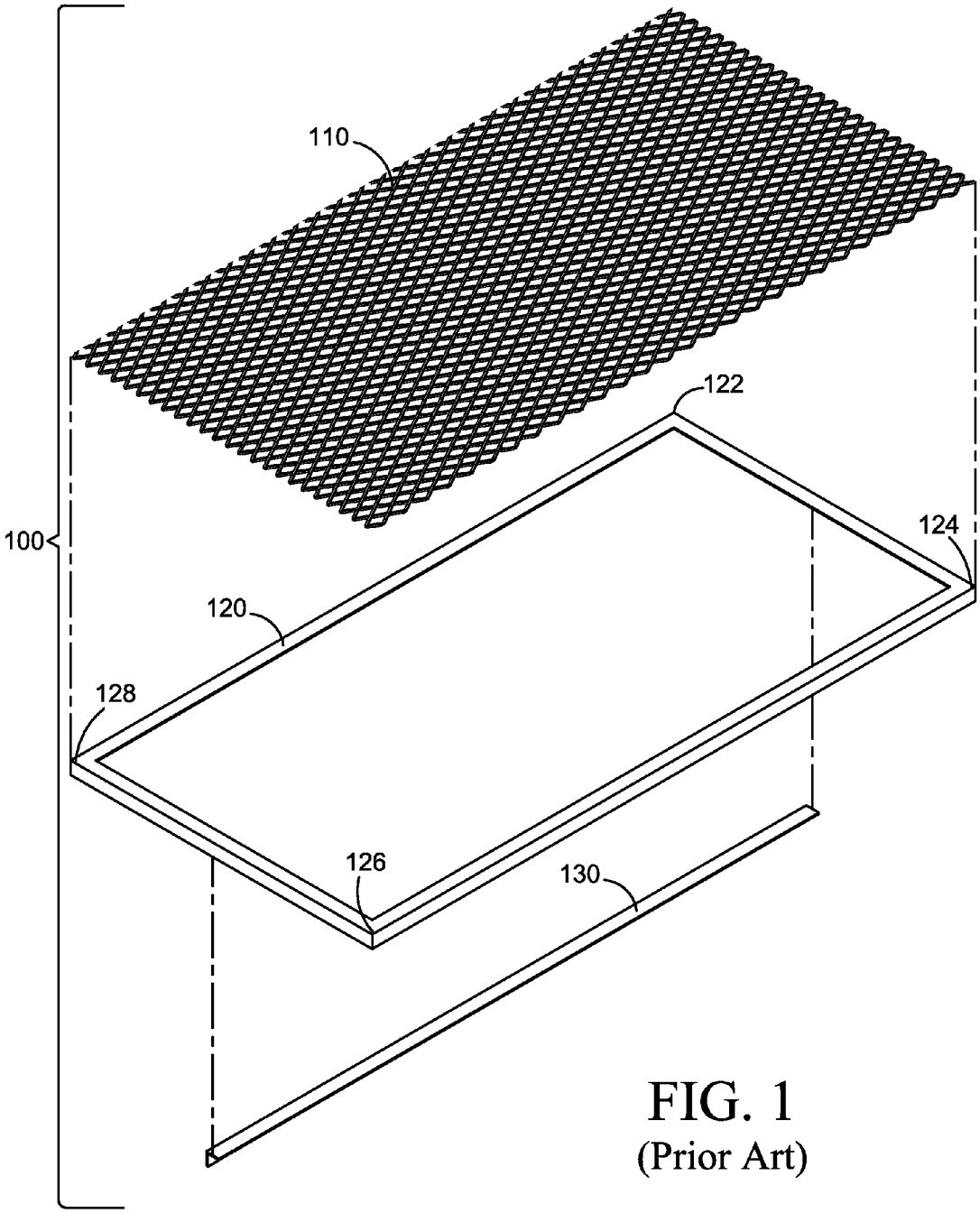
FIG. 1 (Prior Art)
FIG. 1 is an exploded top perspective view of an exemplary prior art panel.
Figure 2:
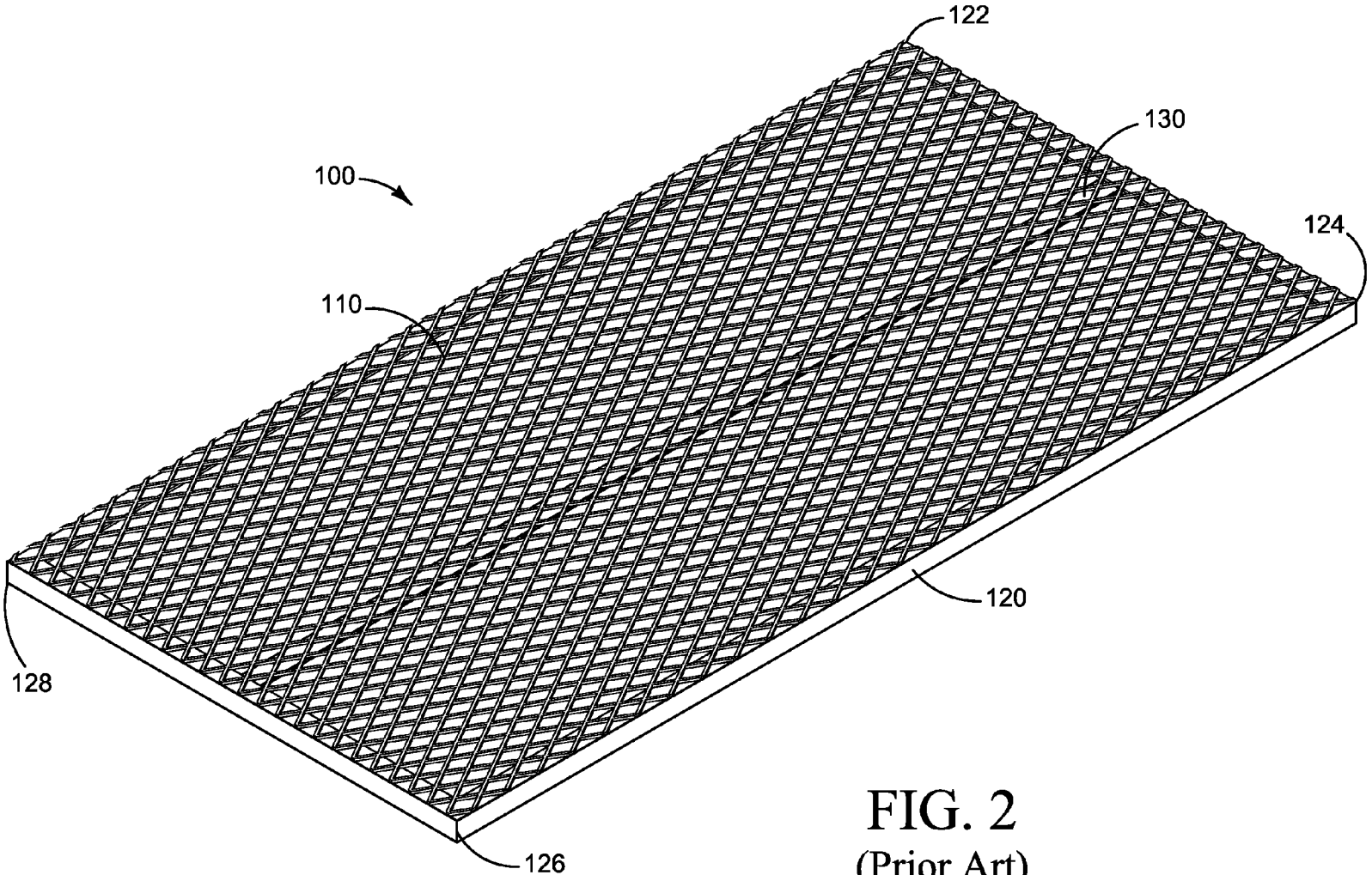
FIG. 2 (Prior Art)
FIG. 2 is an assembled view of the example prior art panel depicted in FIG. 1.

In FIGS. 1 and 2, a example prior art deck plank 100 is shown with an exploded view in FIG. 1 and an assembled view in FIG. 2. Prior art deck plank 100 includes a top 110, frame 120 and optional support bar 130. Top 110 is shown as an optional mesh plank 110, of 4"×8"×1½" expandable iron or aluminum that is typically expanded and welded to the top of the deck frame 120 making a sturdy deck top. In the standard configuration shown, support frame 120 is constructed from 1"×1"×⅛", L-angle iron or aluminum, and welded into a 2'×4' rectangular deck frame, having corners 122, 124, 126, 128. For increased stability and strength, an optional support bar 130 may be added. The support bar 130 is another L-angle beam of the 1"×1"×⅛" size and is typically welded lengthwise to the midpoints of the 2'×4' frame ends.

With reference to FIGS. 3 through 12, the present invention is a modular deck system for construction of a temporary, even, level support surface in the configuration which best meets the user's needs. The deck system includes both a plurality of deck modules as well as a plurality of leg assemblies.

Figure 3:
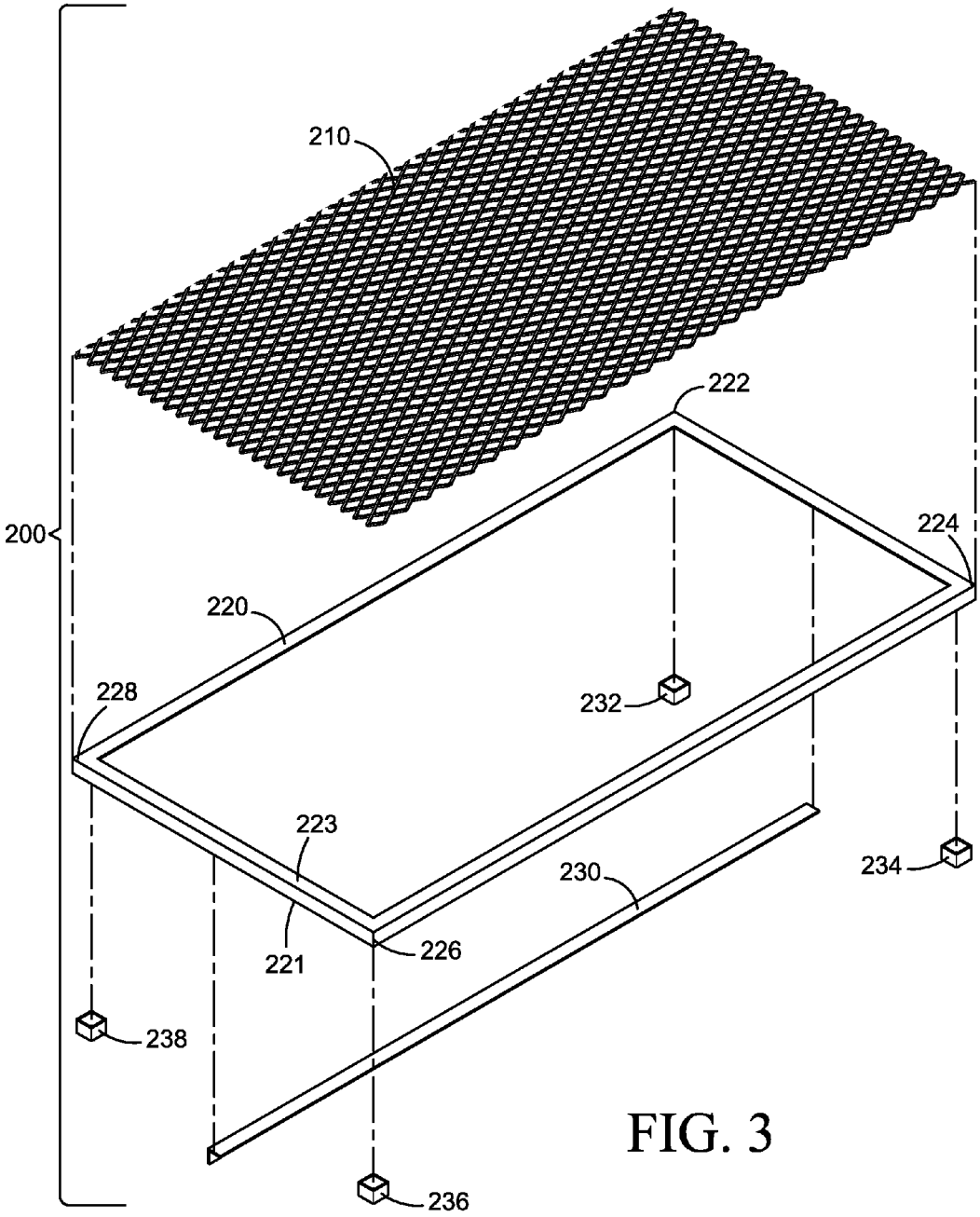
FIG. 3 is an exploded bottom perspective view of the deck panel module of the present invention.
Figure 4:
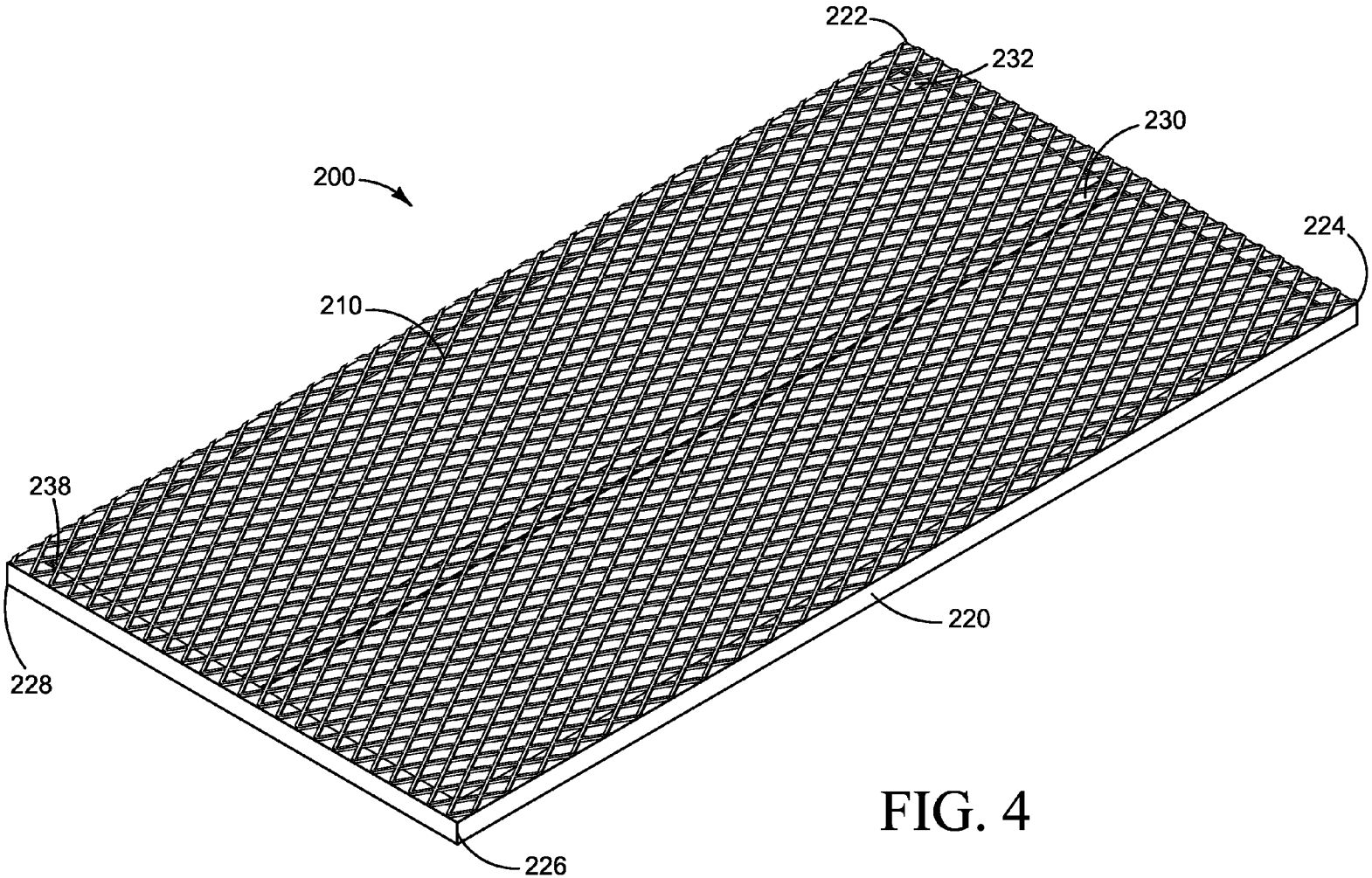
FIG. 4 is an assembled top perspective view of the deck panel module of the present invention.
Figure 5:
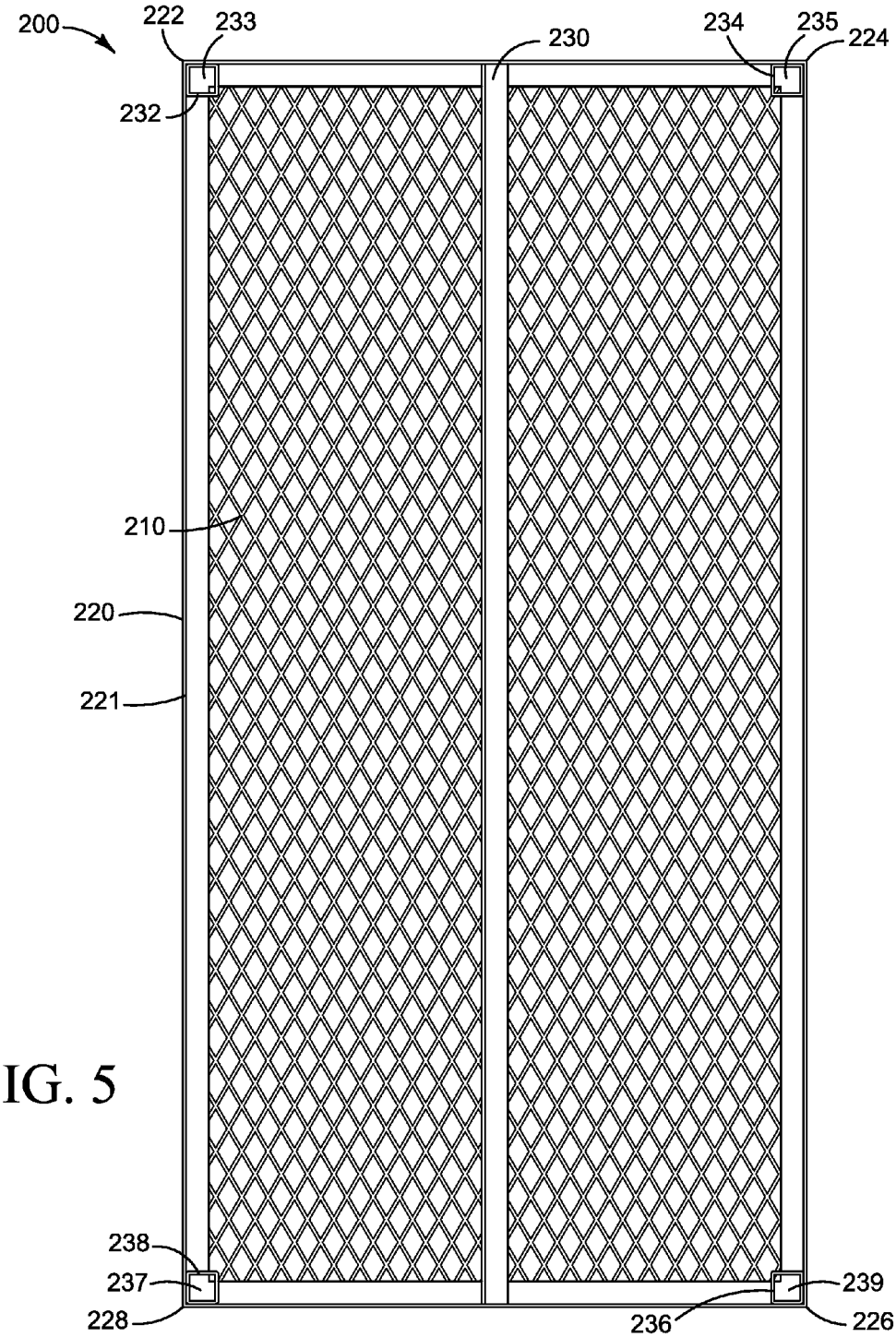
FIG. 5 is an assembled bottom plan view of the deck panel module of the present invention.
Figure 6:
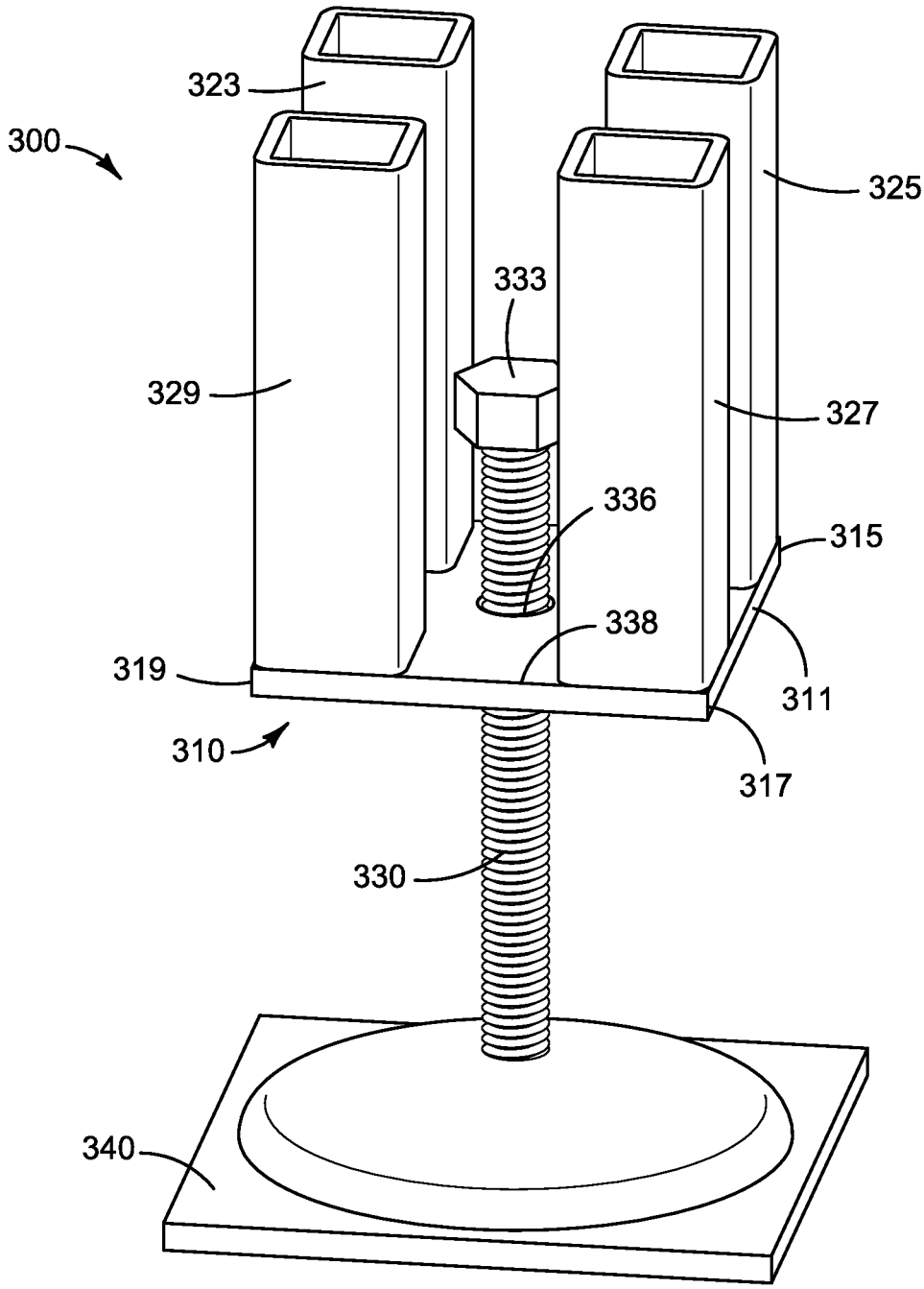
FIG. 6 is a side perspective view of the leg assembly of the present invention.

Referring to FIGS. 3 through 5, the deck module is shown and described. Module 200 includes top 210, frame 220, support bar 230, and receptacles 232, 234, 236, 238. In the exploded view of FIG. 3, the detail of frame 220 is visible and includes bottom surface 221, upper surface 223, and corners 222, 224, 226, 228. The detail further includes leg receptacles or sleeves 232, 234, 236, and 238 which are placed against bottom surface 221 in corners 222, 224, 226, 228 respectively. As shown more closely in FIGS. 3 and 5, leg receptacles 232, 234, 236, 238 are preferably 1¼" square leg receptacles which define a well or aperture 233, 235, 239, 237 for receiving the legs of the invention from the adjacent leg assembles shown.

With reference to FIGS. 6 through 9, the foot-leg assembly is shown and described. Specifically, the leg assembly 300, includes foot or base 340, leg bracket 310, and threaded adjustment bolt 330 having bolt head 333. Leg bracket 310 includes bracket plate 311 having edge 338, corners 313, 315, 317, 319, central aperture 336 and a plurality of legs, 323, 325, 327, 329, extending perpendicularly from plate 311, evenly spaced around edge 338 in the plate corners.

In the preferred embodiment, there are four legs per leg assembly 300. With additional reference to FIG. 5, each leg 323, 325, 327, 329, each leg is a 1" square enabling a secure connection into the 1¼" leg receptacles found underneath on the bottom surface 221 of frame 220 at the deck corners 222, 224, 226, 228. These four evenly spaced legs 323, 325, 327, 229, on the assembly 300, enable up to four separate decking modules to be joined together securely without the use of tools and without unevenness or irregular gaps between deck module 200 sections. If deck expansion is not desired or only two or three additional decking sections are preferred, the foot-base 340 can be rotated to safely hide the remaining legs to decrease the possibility of injury. For example, with reference to FIGS. 10 and 11, unengaged legs of leg assemblies 470 along the outside perimeter of modular deck system 400 are seen through the interior of frames 420, 430, 440, 450.

Figure 7:
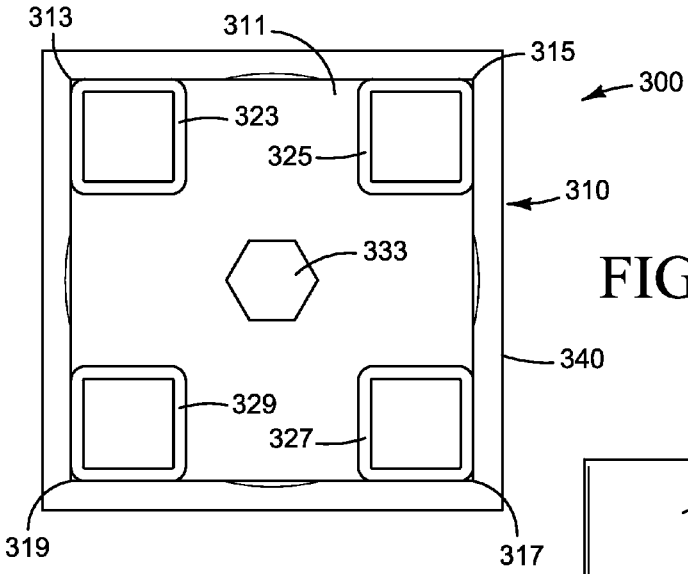
FIG. 7 is a top view of the leg assembly of the present invention.
Figure 8:
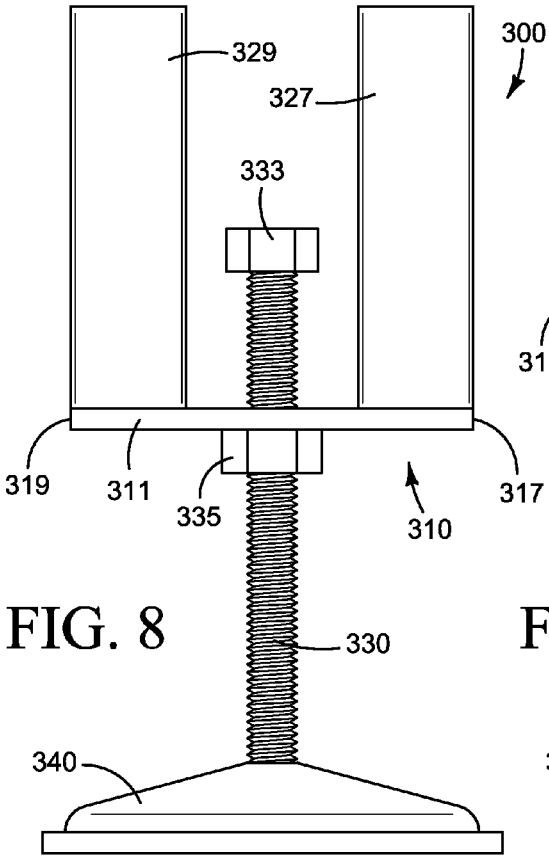
FIG. 8 is a side view of the leg assembly of the present invention set to a mid-range height adjustment.
Figure 9:
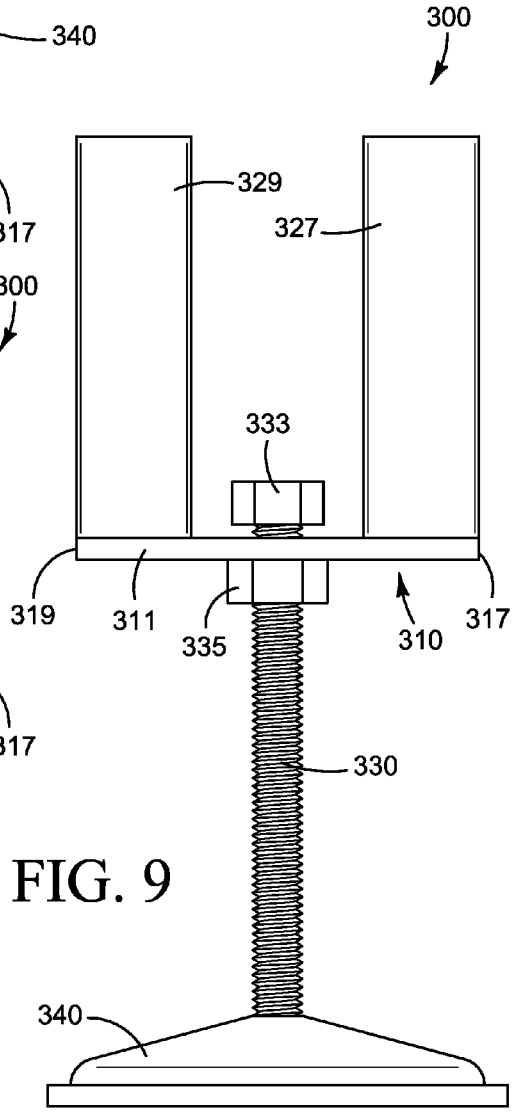
FIG. 9 is a side view of the leg assembly of the present invention set to an upper-range height adjustment.

Another feature of the present invention is the ability to adjust the height of the bracket assembly 310 which thereby raises or lowers the top surface 210 of deck modules 200. With reference to FIGS. 7, 8 and 9, this variation of decking height can also be achieved by rotating the stabilizing foot 340 or by turning the bolt 330. Bolt 330 may be turned manually or by use of a bolt gripping tool on head or nut 333 which is accessible through the evenly spaced gaps between the tops 210 of the decking module 200 units.

FIG. 7 shows the top plan view of the foot-leg bracket assembly 300. The top-side adjustment bolt head 333 is readily accessible by hand or optionally with a bolt-gripping tool placed between the adjacent frames 210 of deck modules 200, 400 through uniform gap 410 as shown in FIGS. 3 through 5 and FIGS. 10 through 11.

Figure 10:
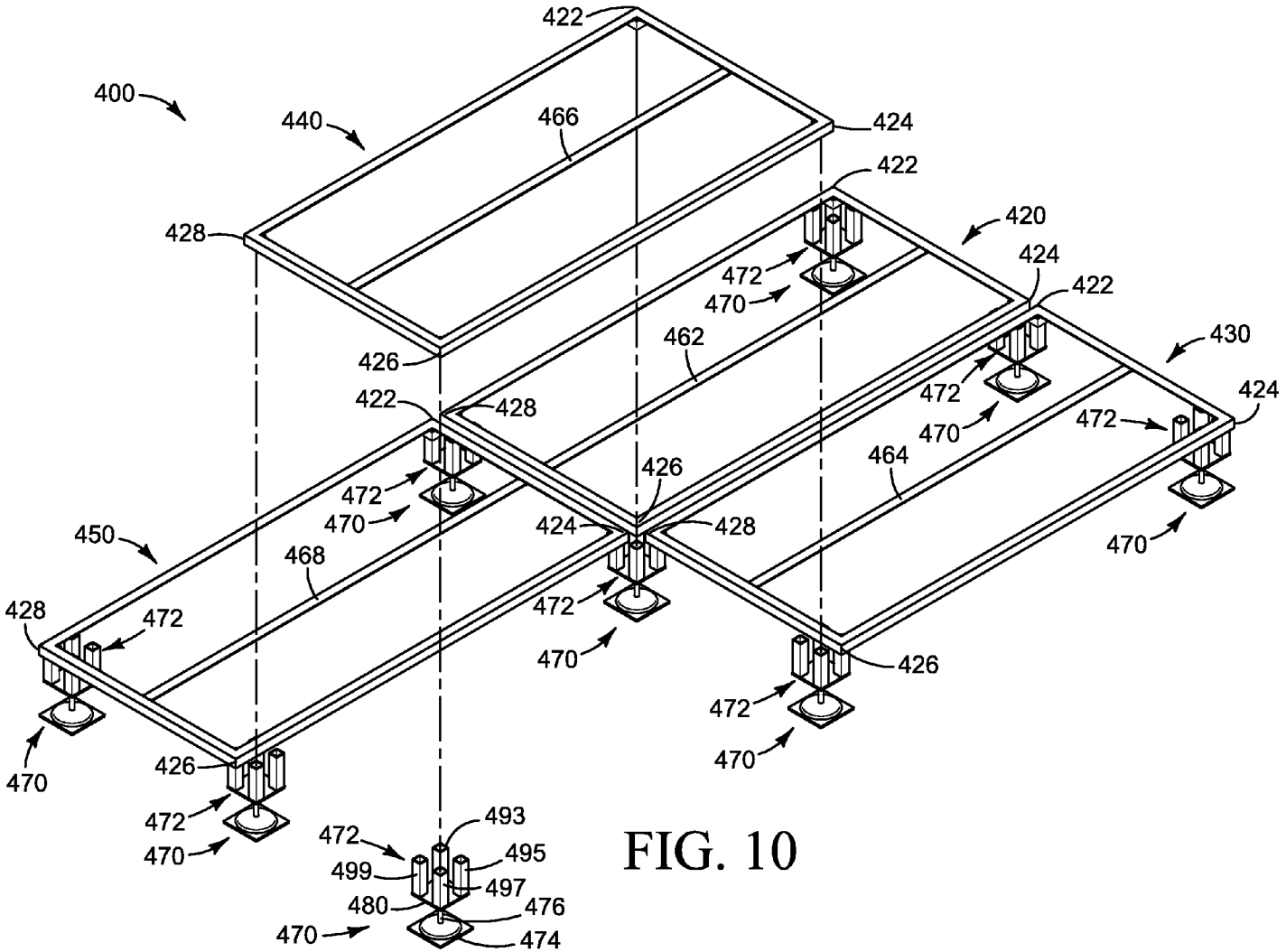
FIG. 10 is a perspective view of four deck modules (without top mesh panels to show interior detail) and nine leg assemblies of the present invention, depicting three adjacent panels secured with eight leg brackets and a fourth panel raised above the remaining leg assembly and leg brackets.
Figure 11:
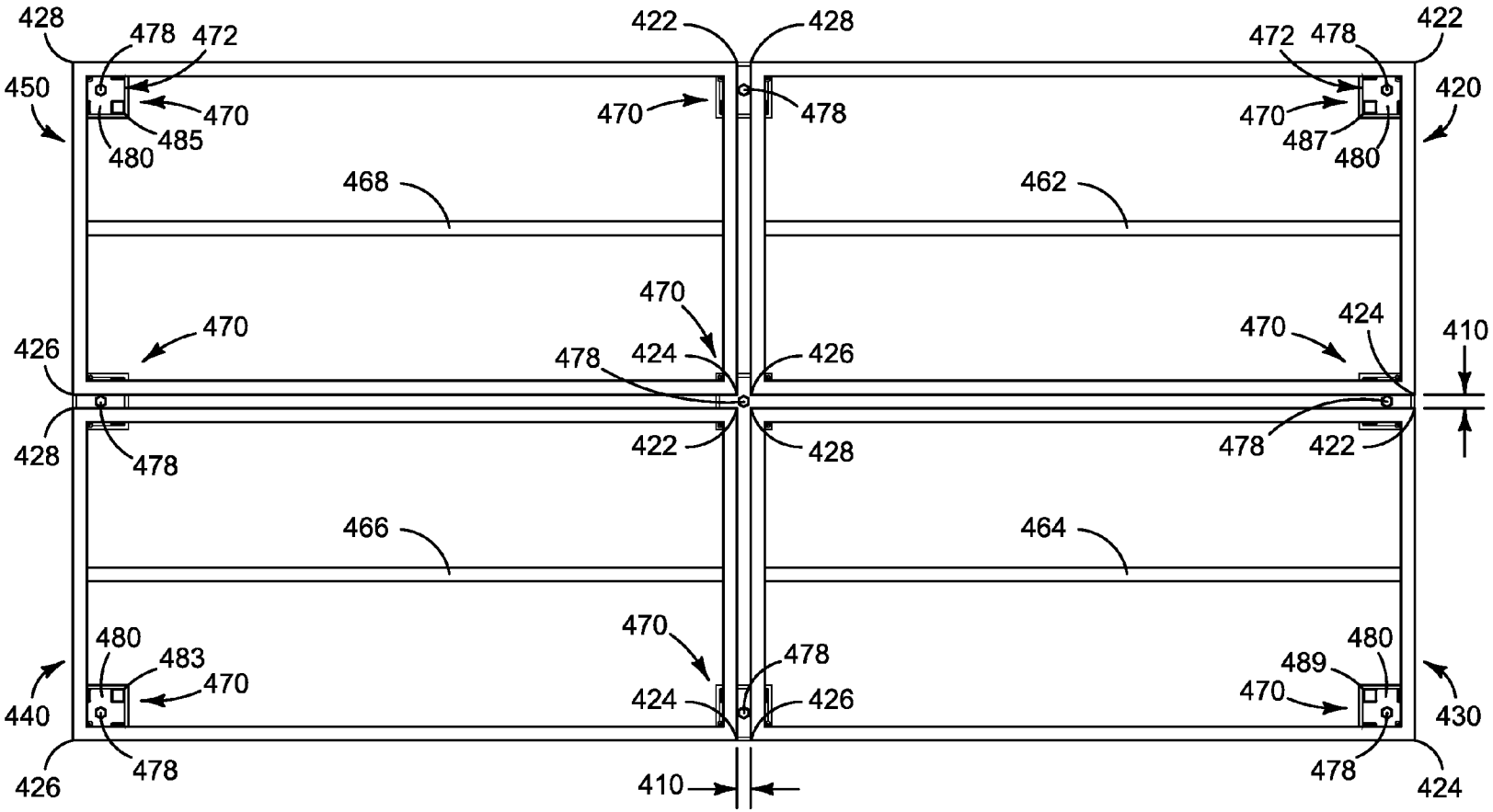
FIG. 11 is a top plan view of the modular deck system shown in FIG. 10, depicting all four panels secured with nine leg assemblies of the present invention (top mesh panels not shown)

With reference to FIGS. 10 and 11, the multiple variable positions of the foot-leg assemblies 470 with modules 420, 430, 440, 450 are shown and described. In FIG. 10, module sections 420, 430, and 450 are in place over leg assemblies 470, with leg brackets 472 already attached such that no unused legs are extending beyond the frames of the modules 420, 430, 440, 450. To complete the system, module 440 will be attached such that corner 422 is secured on a leg assembly which supports the intersection of all four modules 420, 430, 440, 450. At corner 426, the leg receptacle (not visible) will receive leg 497 of leg bracket 480. The remaining legs 493, 495, 499 will be positioned under the frame of module 450.

Figure 12:
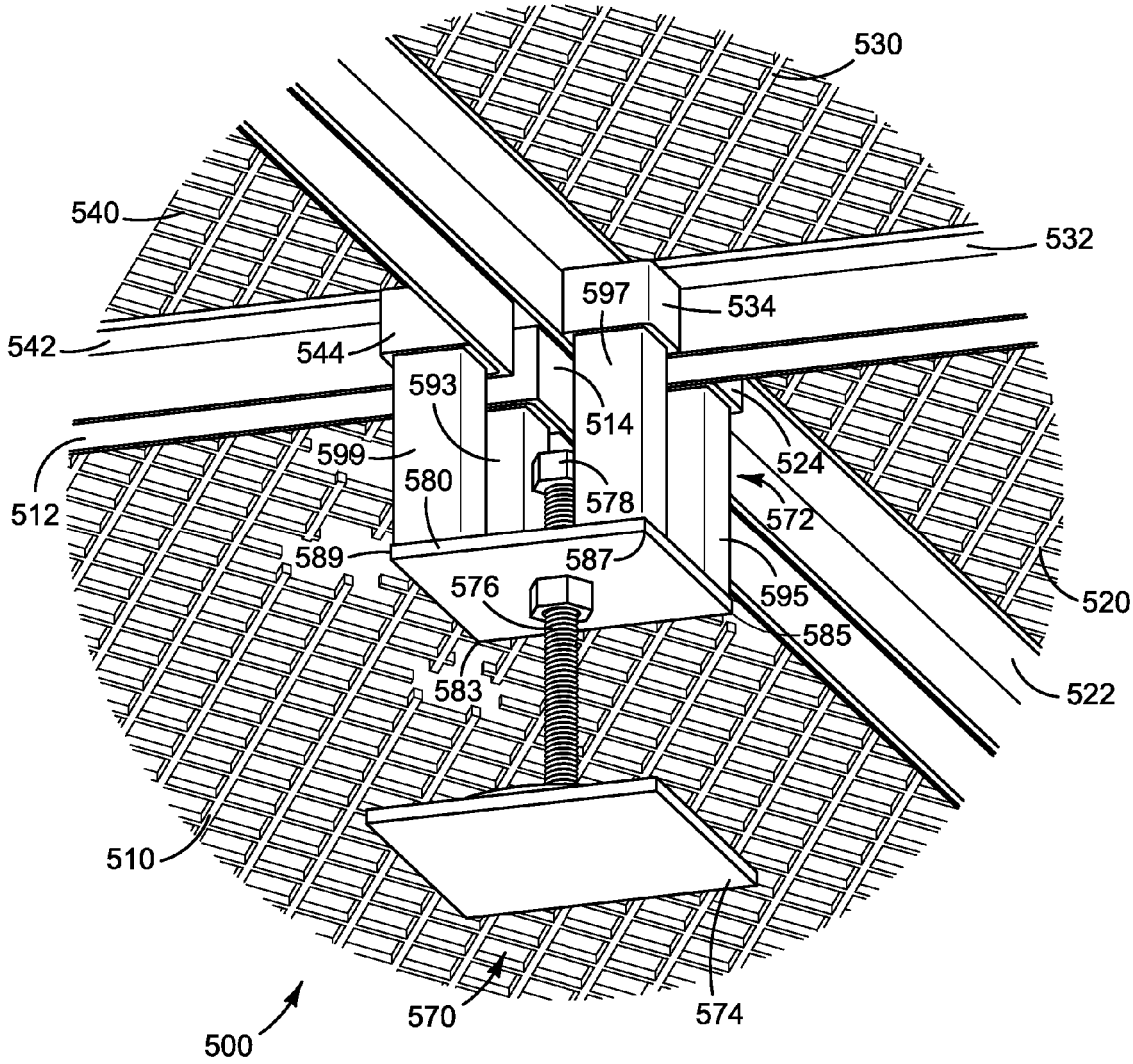
FIG. 12 is a bottom perspective view of an interior leg assembly positioned to secure four deck modules in accordance with the present invention.

An example of a leg assembly supporting four deck modules is shown in FIG. 12. System 500 depicts a bottom view of intersecting modules 510, 520, 530, 540 secured with leg assembly 570 having base 574, bolt 576, with head 578, and leg bracket assembly 572 having legs 593, 595, 597, 599 in corners 583, 585, 587, 589 and extending perpendicularly from plate 580 into leg receptacles, including receptacles 524, 534, 544.

Referring to FIG. 11, the positions of unused legs on leg brackets 470 is more clearly shown. Notice that each perimeter assembly 470 is rotated so that the unused legs of the leg assemblies 470 are turned toward the interior of the modules hidden-under the deck top.

It should be further understood and appreciated that one skilled in the art may modify some portions of the disclosure and still be practicing within the scope and spirit of the present invention.

What is claimed is:

1. A modular deck system, comprising:

a plurality of deck modules, each said deck module having a top panel, a support frame, and a leg receptacle having a sleeve aperture; and a plurality of leg assemblies, each said leg assembly having a base, a bolt, and a leg bracket;

wherein each said leg bracket has four legs extending perpendicularly from a bracket plate of said leg bracket.

2. The modular deck system of claim 1, wherein at least one leg of each leg bracket is received in a leg receptacle of a deck module through the sleeve aperture.

3. The modular deck system of claim 1, wherein said support frame is rectangular and comprises a top edge, a bottom edge, and four corners, and wherein each leg receptacle is adjacent to the bottom edge and proximal to a corner.

4. The modular deck system of claim 1, wherein the bracket plate further comprises an outer edge and a central aperture.

5. The modular deck system of claim 3, wherein said leg bracket comprises four legs uniformly spaced and proximal to the outer edge of said bracket plate.

6. The modular deck system of claim 3, wherein the bolt extends perpendicularly from said base through the central aperture of said bracket plate.

7. The modular deck system of claim 5, wherein said bolt is threaded through said aperture to permit vertical height adjustment of the leg bracket over the base of said leg assembly.

* * * * *